US006065186A

United States Patent [19]

Jermyn, Jr.

[11] Patent Number: 6,065,186

[45] Date of Patent: May 23, 2000

[54] FORCE LIMITING TAPERED SHEAR STOP

[75] Inventor: Richard A. Jermyn, Jr., Panama City, Fla.

[73] Assignee: The United States of America as represented by the Secretary of the Navy, Washington, D.C.

[21] Appl. No.: 09/252,242

[22] Filed: Jan. 14, 1999

[51] Int. Cl.[7] ..... E05F 5/06

[52] U.S. Cl. ..... 16/86 R; 411/5

[58] Field of Search ..... 411/2, 3, 5, 410, 411/903, 401, 388; 16/86 A, 86 R; 292/DIG. 15

[56] References Cited

U.S. PATENT DOCUMENTS

| | | | |
|---|---|---|---|
| 4,096,901 | 6/1978 | Reichenbach | 411/3 |
| 5,092,550 | 3/1992 | Bettini | 411/903 |
| 5,474,408 | 12/1995 | Dinitz | 411/5 |
| 5,486,079 | 1/1996 | Martin | 411/5 |
| 5,713,705 | 2/1998 | Grunbichler | 411/410 |

FOREIGN PATENT DOCUMENTS

| | | | |
|---|---|---|---|
| 1185120 | 10/1957 | France | 16/86 A |
| 2340438 | 10/1977 | France | 16/86 R |

*Primary Examiner*—Flemming Saether
*Attorney, Agent, or Firm*—Harvey A. Gilbert; Donald G. Peck

[57] ABSTRACT

A tapered shear stop has rigid tapered shear stud and tapered polyurethane covering that both have rounded outer surfaces. The tapered shear stop is mounted in a bracket to withstand steady state and impacting loads from a boom and to shear through a reduced section in the stud that is located next to the bracket to prevent bending or transmitting other damage to the bracket when excessive loads are encountered. Differently sized shear stops, or more than one shear stop can be used to protect associated mechanical structure from damage.

5 Claims, 2 Drawing Sheets

FORCE LIMITING TAPERED SHEAR STOP

STATEMENT OF GOVERNMENT INTERESTS

The invention described herein may be manufactured and used by or for the Government of the United States of America for governmental purposes without the payment of any royalties thereon or therefor.

BACKGROUND OF THE INVENTION

Mechanical stops that arrest motion or withstand impacts from moving structural members are many and varied in design. Typically, they may be fabricated to have substantial mass to bear up under repeated impacts, and when some are subjected to excessive loads, they bend or are otherwise distorted as they fail. This type of failure may damage the supporting structure as well as associated machinery and may jam a desired mechanical operation.

One attempt to remedy this undesirable effect was the development of a shear stop which was not tapered along its length so that bending loads were generated in addition to shear loads. This combined loading caused the shear stop to fail at lower loads as compared to loads that were primarily shear loads. In addition, the untapered design was not provided with structure to remove damaged shear stops and to install and tighten new shear stops without a relatively complicated procedure for removal of the bracket which supported the stops. Furthermore, the inner shear stud of the untapered shear stop was hexagonal in cross section. Consequently, it did not consistently present the same amount of buffering coating between the load and the stud. In other words, the thickness of the coating depended upon the rotational location of the flats and points of the hexagonal stud as the stud was tightened. As a result, the failure loads varied greatly.

Thus, in accordance with this inventive concept, a need has been recognized in the state of the art for tapered rounded shear stops that convert loads to primarily shear forces and shear under excessive loads to protect an attached mounting bracket from damage.

SUMMARY OF THE INVENTION

The present invention provides a stop having a tapered resilient cover mounted on a rigid tapered shear stud. The stud has an innermost section engaging a supporting bracket and another section of reduced cross-sectional area as compared to the rest of the stud. The reduced section is located adjacent the engaging section to shear when the tapered cover is subjected to loads in excess of the shear strength of the reduced section. The cover and stud have rounded outer surfaces.

An object of the invention is to provide a limit for the range of travel of a displaceable member.

Another object of the invention is to provide a mechanical stop that shears when excessive steady state or impacting forces are transmitted through a tapered cover by a displaceable member.

Another object of the invention is to provide a tapered shear stop having a tapered stud and resilient cover to concentrate shear forces.

Another object of the invention is to provide a stop that shears under excessive steady state or impacting forces to protect a bracket.

Another object of the invention is to provide a stop that shears under excessive forces to prevent bending of the supporting bracket.

Another object of the invention provides a stop that shears under excessive forces and is easily and inexpensively replaced thereafter.

Another object of the invention is to provide a tapered shear stop concentrating shear loading and minimizing bending in a reduced cross-sectional member to prevent transmission of bending forces to a bracket.

Another object of the invention is to provide a tapered shear stop having reduced cross-section area next to where it is mounted in a bracket to prevent transmission of bending forces to the bracket.

Another object of the invention is to provide a tapered shear stop that bears primarily shear loading in a reduced section adjacent to where it is mounted in a supporting bracket.

Another object of the invention is to provide a stop capable of supporting greater loads since bending forces are minimized and the resulting combined loading is primarily composed of shear loading.

Another object of the invention is to provide a tapered shear stop that prevents transmission of bending forces to a supporting bracket.

Another object of the invention is to provide a tapered shear stop that prevents transmission of bending forces to a supporting bracket so that greater shear loads can be supported.

Another object of the invention is to provide a tapered shear stop capable of supporting an increased load before failure occurs.

Another object of the invention is to provide a tapered shear stop having driver structure at its outermost extremity to allow tightening from its exposed outside without removing the bracket.

Another object of the invention is to provide a tapered shear stop that is round in construction to always present the same structural profile to an applied radial load so that the shear breaking load is more consistent than the old hexagonally-shaped stud.

Another object of the invention is to provide a tapered shear stud having driver structure at both ends to ease removal of a damaged stud and installation of a new stud.

These and other objects of the invention will become more readily apparent from the ensuing specification when taken in conjunction with the appended claims.

DESCRIPTION OF THE PREFERRED EMBODIMENT

Figure 1C:
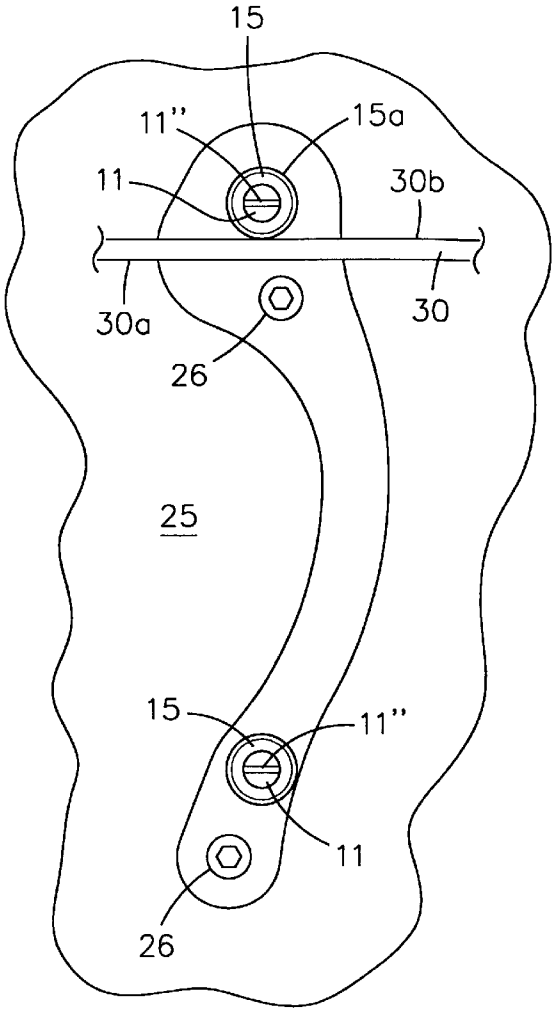
FIGS. 1A, 1B, and 1C show back, side, and front views of a bracket mounting two tapered shear stops according to this invention.
Figure 1B:
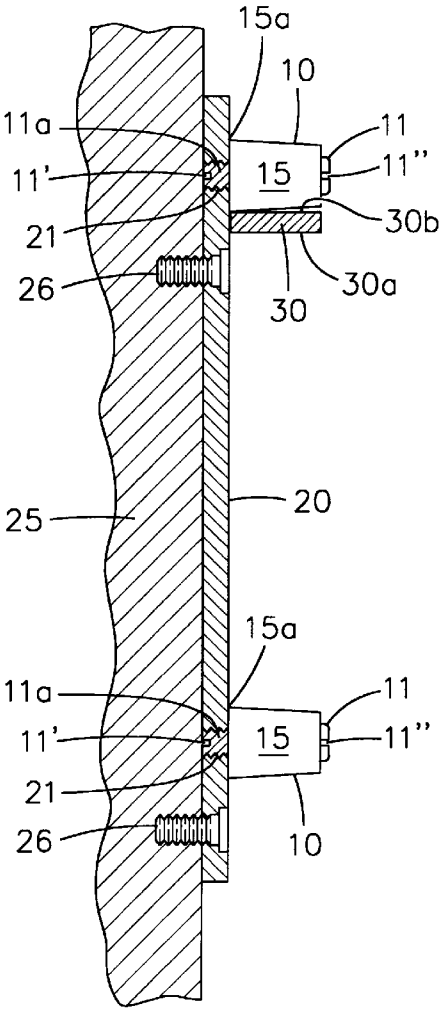
Figure 1A:
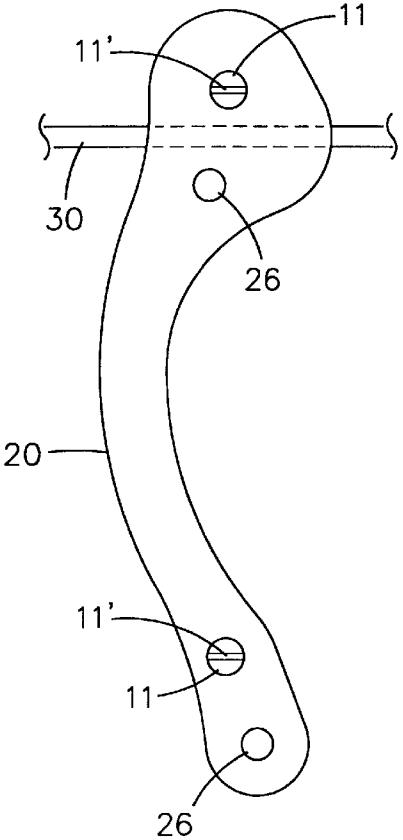

Referring now to FIGS. 1A, 1B, and 1C, two tapered shears stops 10 are mounted on supporting bracket 20 in threaded bores 21. Bracket 20 is rigid and may be mounted on bulkhead 25 via bolts 26. Tapered shear stops 10 are secured to bracket 20 to limit upward and downward motions of and to withstand one or more impacts from rigid boom 30.

Boom 30 has flat surfaces 30*a* and 30*b* that contact tapered shear stops 10. Boom 30 may be pivotally mounted at one end on a tow vehicle, and its other end could be joined to a tether extending to an object being towed through the air or water. Boom 30 is free to move up and down as the object reacts to turbulence and other anomalies created as it passes through the fluid, and in so doing, flat surfaces 30*a* and 30*b* of boom 30 may bear against or hit against tapered shear stops 10 with considerable forces. If and when these contacts and/or impacts occur, tapered shear stops 10 function to withstand these forces or shear-off without transmitting forces that may damage bracket 20 or bulkhead 25.

Figure 2C:
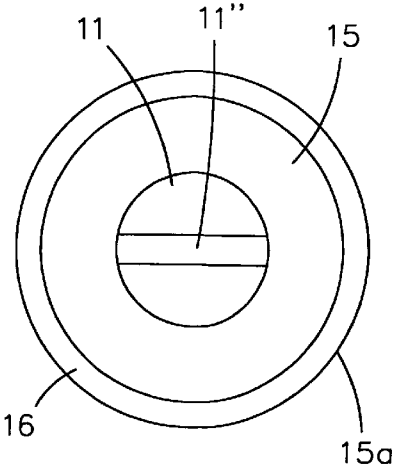
FIGS. 2A, 2B, and 2C respectively show inner-end, side, and outer-end view of the tapered shear stop of this invention.
Figure 2B:
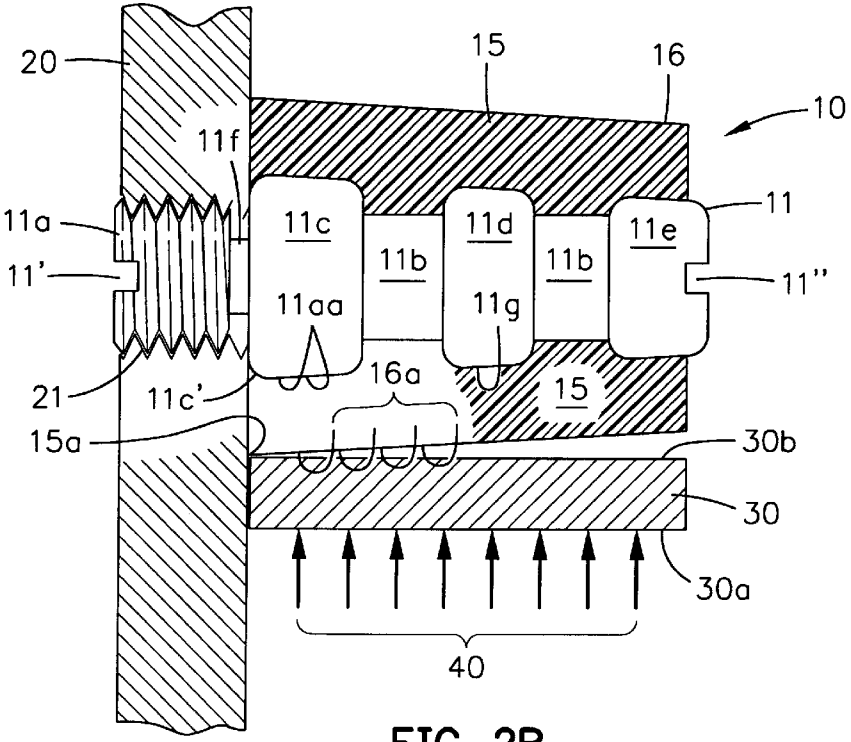
Figure 2A:
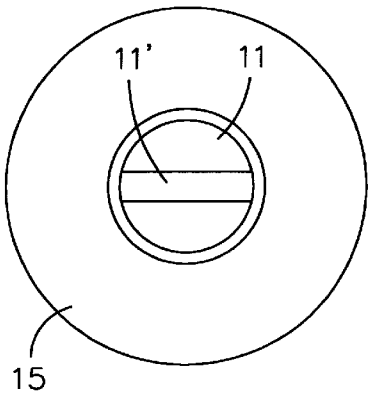

Referring to FIGS. 2A, 2B, and 2C, each tapered shear stop 10 has elongate and rounded tapered shear stud 11 that may be machined by a lathe from an exemplary material, such as CRES 304 per QQ-S-763 and passivated per QQ-P-35, Type VI or VII. CRES 304 is corrosion resistant steel, alloy 304, QQ-P-35 is a U.S. Federal Specification for "steel bar wire, shape and forging corrosion resisting" and QQ-P-35 is a U.S. Federal Specification for "passivation treatments for corrosion resistant steel." Such a surface treatment process is used to remove free iron from the stainless steel outer surface which would otherwise rust. This exemplary material is only one of many other hard materials which could be selected, such as metals or plastics as well as other suitable synthetics for stud 11.

Shear stud 11 has, for example, threaded section 11*a* and central sections 11*b* having, typically, outer diameters of about 0.313 inches. The threads of section 11*a* mate with threads in threaded bores 21 in bracket 20. Stud 11 also is provided with first radially outwardly extending section 11*c* having a maximum outer diameter, typically, of 0.400 inches at 11*c*'. First section 11*c* is aligned with second and third radially outwardly extending sections 11*d* and 11*e*, since these sections 11*c*, 11*d*, and 11*e* have been machined so that their outer surfaces have, typically, a 1.43+/−0.5° taper (No. 2 Morse taper) that extends from 11*c*' of first section 11*c*. In addition, to these rounded sections, stud 11 has rounded section 11*f* that has a smaller, or reduced cross-sectional area as compared to the cross-sectional areas of other parts of stud 11. Reduced section 11*f* is located between threaded section 11*a* and part 11*c*' of section 11*b* and has an outer diameter of about 0.175 inches.

Tapered shear stud 11 has its opposite ends shaped with driver structure 11' or 11" that permits insertion and removal of shear stud 11 into or out of bore 21 of bracket 20. Such driver structure may be formed as driver slots 11' or 11" to receive a screwdriver for insertion or removal of tapered shear stop 10. Other configurations for either or both of these driver structures could be made as described below.

Tapered coating or covering 15 of polyurethane is molded, adhered, or otherwise secured onto the exterior of shear stud 11. Tapered coating, or covering 15 is shaped as a conical frustum having outer surface 16 disposed radially outwardly from shear stud 11. Outer surface 16 has essentially the same taper as the exterior of first, second, and third sections 11*c*, 11*d*, and 11*e* of shear stud 11. Tapered coating 15 may have an average thickness of about 0.112 inches. An exemplary material for tapered coating 15 is durable resilient material, such as polyurethane, that is cast on tapered stud 11 in a suitably shaped mold according to well-known practices. A typical durometer hardness reading for polyurethane cover 15 registers about 45 Shore D. Polyurethane cover 15 also could be fabricated from other suitable plastic, rubber, synthetic, polymer or gum materials having suitable resilient, or compressive or compression-resistant or restorative properties with typical durometer readings between 20 and 100.

Tapered shear stop 10 of this invention having tapered shear stud 11 coated by similarly tapered polyurethane cover 15 provides novel features. Stop 10 creates primarily, or substantially pure, shear across reduced section 11*f*. This causes shear failure in section 11*f* when a sufficiently high parallel load 40 is applied via surfaces 30*a* and 30*b* in a direction that is perpendicular to the longitudinal axis of stop 10. This is because first contact with load 40 occurs at 15*a*. 15*a* is the radially outwardmost part of coating 15 and is radially outward from 11*c*', that is, the radially outwardmost part of stud 11.

When load 40 increases perpendicular to the axis of tapered shear stud 11, additional regions 16*a* of surface 16 of polyurethane coating 15 and additional regions 11aa of shear stud 11 come under load. As cover 15 is compressed, the load remains greatest at 15*a* and 11*c*'. Under more load 40, shear stop 10 maximizes shear forces (directly downward) on section 11*f* and minimizes any bending force on section 11*f* even though there is increasing resistance to load 40 through regions 11*aa* and 16*a*.

In other conventional designs, bending forces are combined with shear forces to cause failure of a supporting bolt. However, in accordance with this invention, reduced cross section 11*f* minimizes bending forces in tapered shear stop 10 so that failure of section 11*f* is primarily the result of pure shear force, and thus, a larger force 40 can be supported before failure will occur in tapered shear stop 10.

Threaded section 11a provides cantilevered support for stop 10 in bracket 20 and is installed/tightened in bore 21 of bracket 20 by utilizing either driver slot 11' or slot 11". Driver slot 11' may be accessed through the backside of bore 21 of bracket 20 after bolts 26 are removed. When the tapered shear stop 10 fails (shears) at section 11*f*, then threaded section 11*a* of the failed shear stop must be removed before a replacement tapered stop 10 can be installed. If threaded section 11*a* can be removed from the front side by use of some frictional engaging device/pliers/etc., then the backside of bracket 20 need not be exposed by removal of bolts 26 in order to access driver slot 11' for this removal purpose. This type removal (without removal of bracket 20) is often possible because the shear type breakage at reduced section 11*f* does not contact or otherwise interfere with the threads in bracket 20 simply because reduced section 11*f* is smaller than the cross-sectional area of threaded section 11*a* in bracket 20. A great amount of mission time and associated costs is thereby saved by not having to remove bracket 20 in order to replace tapered shear stop 10. However, threaded section 11*a* of the old, sheared-off stop 10 may always be removed by removing the bracket 20 and then using driver slot 11' for removal. Once the broken section 11*a* has been removed, a new tapered shear stop 10 may be installed and tightened via driver slot 11" which does not require the removal of bracket 20. If tapered shear stop 10 needs to be removed for one reason or another, driver slot 11" permits such removal.

Tapered shear stop 10 has a larger diameter at edge 15*a* of cover 15 that is longitudinally nearest to reduced section 11*f* and a smaller diameter away from section 11*f*. This shape concentrates and applies radial loads along a straight line through 15*a* and 11*c*' that extends perpendicular to the longitudinal axis of stop 10. This concentrated radial load is nearest to the cantilevered support of stop 10 in bracket 20 so that bending forces are minimized and the resulting combined loading is primarily pure shear load. Thus, greater loads may be supported by stop 10 before failure occurs since bracket 20 can support such shear loading when it is subjected to relatively little bending force. Bracket 20 and bulkhead 25 also are protected from deformation.

Tapered shear stud 11 of shear stop 10 has driver slot 11" at its end so that tapered shear stud 11 can be tightened from outside of bracket 20. Thus, bracket 20 need not be removed to tighten shear stop 10, and there is no need to grip polyurethane cover 15 of shear stop 10 to tighten stud 11. Accordingly, possible clamping and twisting damage to cover 15 is prevented.

Another feature of shear stop 10 is that on any point along the longitudinal axis of shear stop 10, the radial dimensions of sections 11*b*, 11*c*, 11*d*, 11*e*, and 11*f* of tapered stud 11 are rounded and uniform throughout 360°-arc in a radial plane extending around the longitudinal axis. This uniformity in thickness of stud 11 always presents the same structural profile to applied radial load 40 irrespective of the position that shear stop 10 has been rotated to in bore 21 of bracket 20. Similarly, on any point along the longitudinal axis of shear stop 10 beyond reduced section 11*f*, the radial dimensions of tapered cover 15 are uniform throughout 360°-arc in a radial plane extending around the longitudinal axis. This uniformity in thickness of tapered cover 15 always presents the same structural profile to applied radial load 40 irrespective of the position that shear stop 10 has been rotated to in bore 21 of bracket 20. Thus, shearing loads for stop 10 are more consistent, and more predictable, than hexagonal studs of the prior art.

The degrees of taper of shear stud 11 and covering 15 may vary. More taper has been found to concentrate shearing forces nearer to the point of attachment of threaded section 11a and reduce the bending component of combined loading. This provides a higher breaking limit. In addition, shear stop 10 may be manufactured using other compounds for the cast coating 15 which have other desirable resilient, compressive hardness/durometer, or compressive yield limits. These compounds may either spread out or concentrate loads, which includes steady state forces and forces attributed to successive impacts, onto shear stud 11. Other coating compounds may be used which will preferentially tear or fail in compressive failure such that the inner shear stud 11 itself will be left to support parallel load 40. This places the support very near to the highest radial point, or region 11*c*' of first section 11*c* of shear stud 11, and because shear stud 11 is made of hard material which compresses little, little load will be borne outwardly along its axis.

The constituents of shear stop 10 might be modified or otherwise tailored so that shear stop 10 may satisfactorily perform for different tasks, yet such modifications will be within the scope of this inventive concept. For example, flat driver slots 11' and 11" in shear stud 11 may be replaced with any other common, internal drivers shaped as cross point, hex socket, etc. Internal driver structures, such as hex or Allen socket, offer additional advantages. Threaded end section 11*a* may be modified so that an internal socket can extend entirely through it and reduced section 11*f*. This internal socket will allow removal of threaded section 11*a* from outside of bracket 20 by an Allen wrench if shear stud 11 has broken (sheared) at reduced section 11*f*.

Having the teachings of this invention in mind, modifications and alternate embodiments of this invention may be fabricated to have a wide variety of applications in many other mechanical systems. For example, in accordance with this invention, a series of successively larger, or stronger shear stops 10 could be serially arranged so that they could shear off in sequence to cushion otherwise catastrophic loads and impacts. Furthermore, number of shear stops 10 could be cascaded in parallel to provide such a capability. Different fabrication materials and shapes of these materials for stud 11 and cover 15 could be incorporated to accommodate many other load requirements without departing from the scope of this invention. In addition, some uses of this invention might not require the resilient/cushioning properties of cover 15. In this cases, cover 15 might be eliminated, and shear stud 11 might function alone to support loads and/or shear under excessive loads in accordance with this invention.

The disclosed components and their arrangements as disclosed herein all contribute to the novel features of this invention. This invention provides a reliable and cost-effective means to withstand excessive loads in the form of steady-state forces and forces from repeated impacts in a host of different devices. Therefore, tapered shear stop 10, as disclosed herein is not to be construed as limiting, but rather, is intended to be demonstrative of this inventive concept.

It should be readily understood that many modifications and variations of the present invention are possible within the purview of the claimed invention. It is to be understood that within the scope of the appended claims the invention may be practiced otherwise than as specifically described.

I claim:

1. A tapered shear stop having a tapered resilient cover mounted on a rigid tapered shear stud, said stud having a section to engage a bracket and another section of reduced cross section as compared to the rest of said stud, said reduced section being located adjacent said engaging section to shear and prevent transmission of bending forces to said bracket when subjected to loads greater than the shear strength of said reduced section, said cover and stud having rounded outer surfaces.

2. A tapered shear stop according to claim 1 in which said rounded outer surfaces are uniform throughout each 360°-arc in each radial plane extending around longitudinal axis of said cover and stud.

3. A tapered shear stop according to claim 2 in which said stud and said cover receive said loads perpendicular to said longitudinal axis on a portion of said cover disposed adjacent to and radially outward from said reduced section.

4. A tapered shear stop according to claim 3 further comprising:

driver structure mounted on opposite ends of said stud.

5. A tapered shear stop according to claim 4 in which said loads are transmitted to said portion by a boom.

* * * * *